US007621788B1

(12) United States Patent
Feng

(10) Patent No.: US 7,621,788 B1
(45) Date of Patent: Nov. 24, 2009

(54) PIN-CARRIER FOR CONNECTOR

(75) Inventor: Dong-Chu Feng, Dongguan (CN)

(73) Assignee: Comtek Electronics Co., Ltd. (CN)

( * ) Notice: Subject to any disclaimer, the term of this patent is extended or adjusted under 35 U.S.C. 154(b) by 0 days.

(21) Appl. No.: 12/353,061

(22) Filed: Jan. 13, 2009

(30) Foreign Application Priority Data

Sep. 8, 2008 (CN) ..... 2008 2 0134014 U

(51) Int. Cl.
*H01R 9/24* (2006.01)

(52) U.S. Cl. ..... 439/885

(58) Field of Classification Search ..... 439/885, 439/884, 637, 60
See application file for complete search history.

(56) References Cited

U.S. PATENT DOCUMENTS 5,848,920 A * 12/1998 Klein et al. ..... 439/885
6,299,492 B1 * 10/2001 Pierini et al. ..... 439/884
6,764,357 B2 * 7/2004 Wu et al. ..... 439/885
7,452,249 B2 * 11/2008 Daily et al. ..... 439/825
7,458,839 B2 * 12/2008 Ngo et al. ..... 439/291

* cited by examiner

*Primary Examiner*—Chandrika Prasad
(74) *Attorney, Agent, or Firm*—Hershkovitz & Associates, LLC; Abraham Hershkovitz

(57) ABSTRACT

A pin-carrier for a connector has a main panel defining a plane, a secondary panel, a first pin set with multiple first pins and a second pin set with multiple second pins being connected between the main panel and the secondary panel, wherein the first and second pins have connecting segments being raised or lowered relative to the plane. Therefore, manufacturing the pin-carrier requires fewer steps, fewer tools and since the pins are connected to both panels, has higher yields. Therefore, manufacturing the pin-carrier is low cost and convenient.

16 Claims, 6 Drawing Sheets

PIN-CARRIER FOR CONNECTOR

BACKGROUND OF THE INVENTION

1. Field of the Invention

The present invention relates to a pin-carrier for a connector, especially to a pin-carrier that can be made easily, is low cost and increases manufacturing yield.

2. Description of the Prior Arts

With reference to FIGS. 5 and 6, a conventional first pin-carrier (50) has a first plate (51), nine first pins (52) and a cutting notch (53). The first plate (51) has an edge. The first pins (52) are separately and parallelly formed on and protrudes from the edge of the first plate (51). Each first pin (52) has a connecting terminal (521) and a mounting terminal (522). The connecting terminals (521) of the first pins (52) are formed on and protrude from the edge of the first plate (51), are flush with the first plate (51) and each connecting terminal (521) has a proximal end. The mounting terminals (522) of the first pins (52) are transversely formed on and protrude respectively from the proximal ends of the connecting terminals (521) of the first pins (52) and each mounting terminal (522) comprises an extension section perpendicular to the connecting terminal (521). The cutting notch (53) is formed between and along the edge of the first plate (51) and the proximal ends of the connecting terminals (521) of the first pins (52).

With further reference to FIGS. 7 and 8, the conventional second pin-carrier (60) has a second plate (61), ten second pins (62) and a cutting notch (63). The second plate (61) has an edge. The second pins (62) are separately and parallelly formed on and protrude from the edge of the second plate (61). Each second pin (62) has a connecting terminal (621) and a mounting terminal (622). The connecting terminals (621) of the second pins (62) are formed on and protrude from the edge of the second plate (61), are flush with the second plate (61) and each connecting terminal (621) has a proximal end. The mounting terminals (622) of the second pins (62) are transversely formed on and protrude respectively from the proximal ends of the connecting terminals (621) of the second pins (62) and each mounting terminal (622) has an extension section perpendicular to the connecting terminal (621). The extension sections of the second pins (62) are shorter than the extension sections of the first pins (52). The cutting notch (63) is formed between and along the edge of the second plate (61) and the proximal ends of the connecting terminals (621) of the second pins (62).

The first and the second pin-carriers (50, 60) are cut along the cutting notches (53, 63) to form nine separated first pins (52) and ten separated second pins (62). Then the first and the second pins (52, 62) are mounted in a High Definition Multimedia Interface (HDMI) connector. In the HDMI connector, each first pin (52) is arranged between two adjacent second pins (62). Since the extension sections of the second pins (62) are shorter than the extension sections of the first pins (52), when the mounting terminals (522, 622) are aligned, the connecting terminals (521, 621) of the first and the second pins (52, 62) form two parallel layers.

However, two different molds and manufacturing processes are needed to form the pin-carriers (50, 60). Therefore, designing the molds and manufacturing the pin-carriers (50, 60) increases manufacturing costs. Further, when stamped from sheet metal, because the pins (52, 62) pin-carriers (50, 60) are thin and unsupported, they may deform or break causing rejects and further raising manufacturing costs and yields.

To overcome the shortcomings, the present invention provides a pin-carrier for a connector to mitigate or obviate the aforementioned problems.

SUMMARY OF THE INVENTION

The main objective of the present invention is to provide a pin-carrier for a connector. The pin-carrier has a main panel defining a plane, a secondary panel, a first pin set with multiple first pins and a second pin set with multiple second pins being connected between the main panel and the secondary panel, wherein the first and second pins have connecting segments being raised or lowered relative to the plane.

Therefore, manufacturing the pin-carrier requires fewer steps, fewer tools and since the pins are connected to both panels, has higher yields. Therefore, manufacturing the pin-carrier is low cost and convenient.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
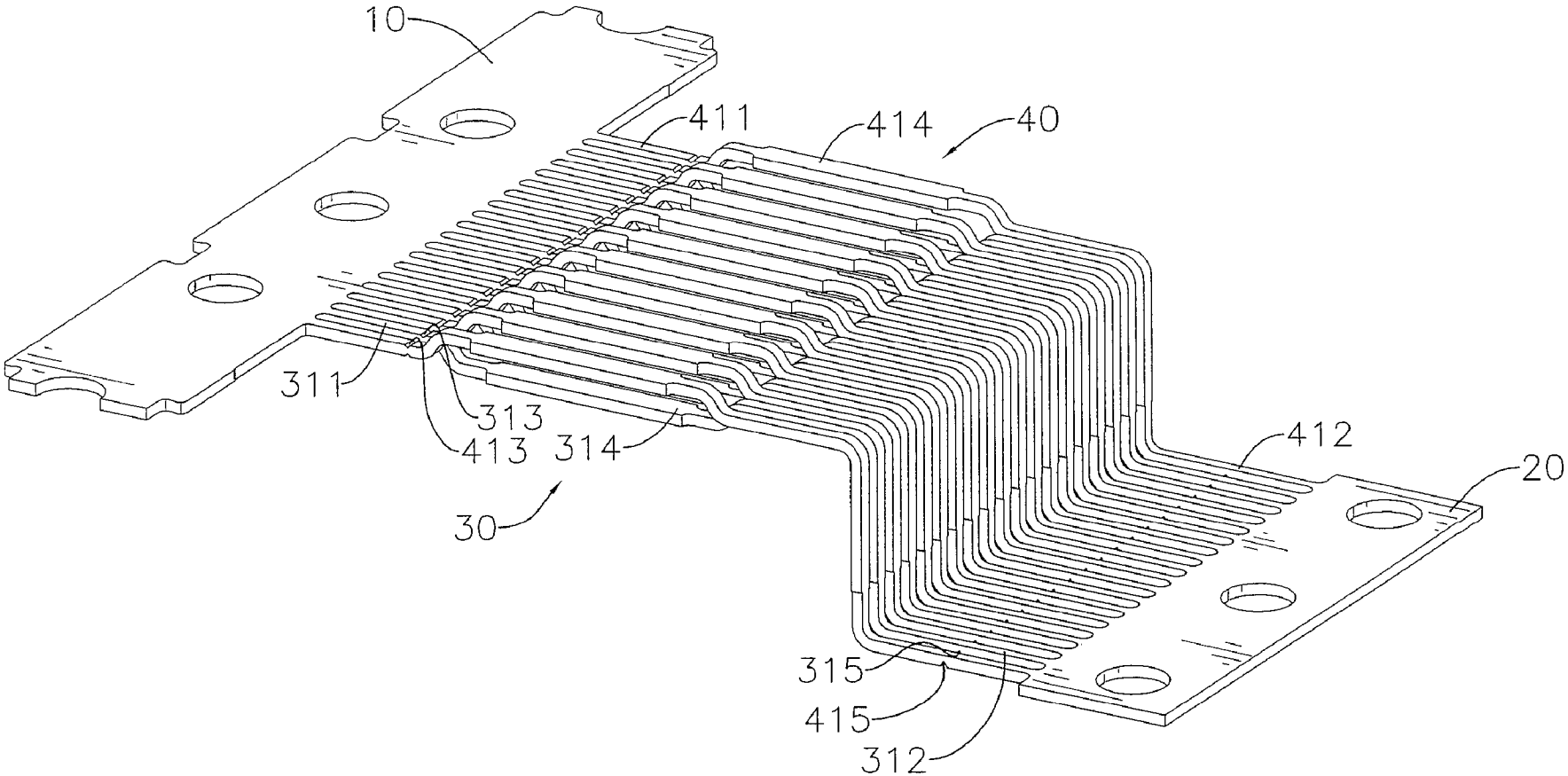
FIG. 1 is a perspective view of a pin-carrier for a connector in accordance with the present invention.

With reference to FIG. 1, a pin-carrier for a connector in accordance with the present invention may be a High-Definition Multimedia interface (HDMI) pin-carrier for an HDMI connector and comprises a main panel (10), a secondary panel (20), a first pin set (30) and a second pin set (40).

The first panel (10) defines a plane.

The secondary panel (20) is parallel with and may be smaller than the main panel (10).

Figure 3:
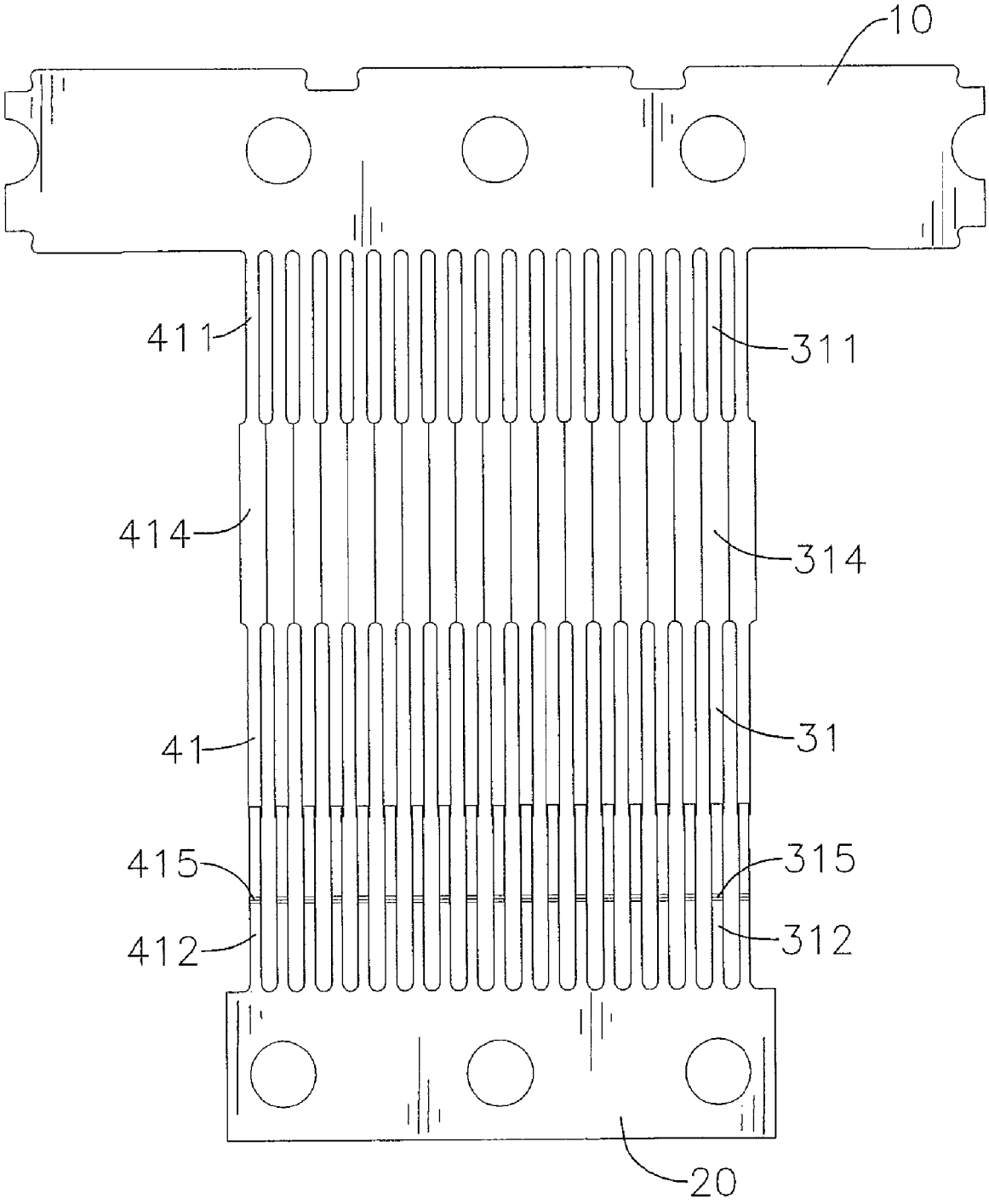
FIG. 3 is a rear view of the pin-carrier in FIG. 1.
Figure 4:
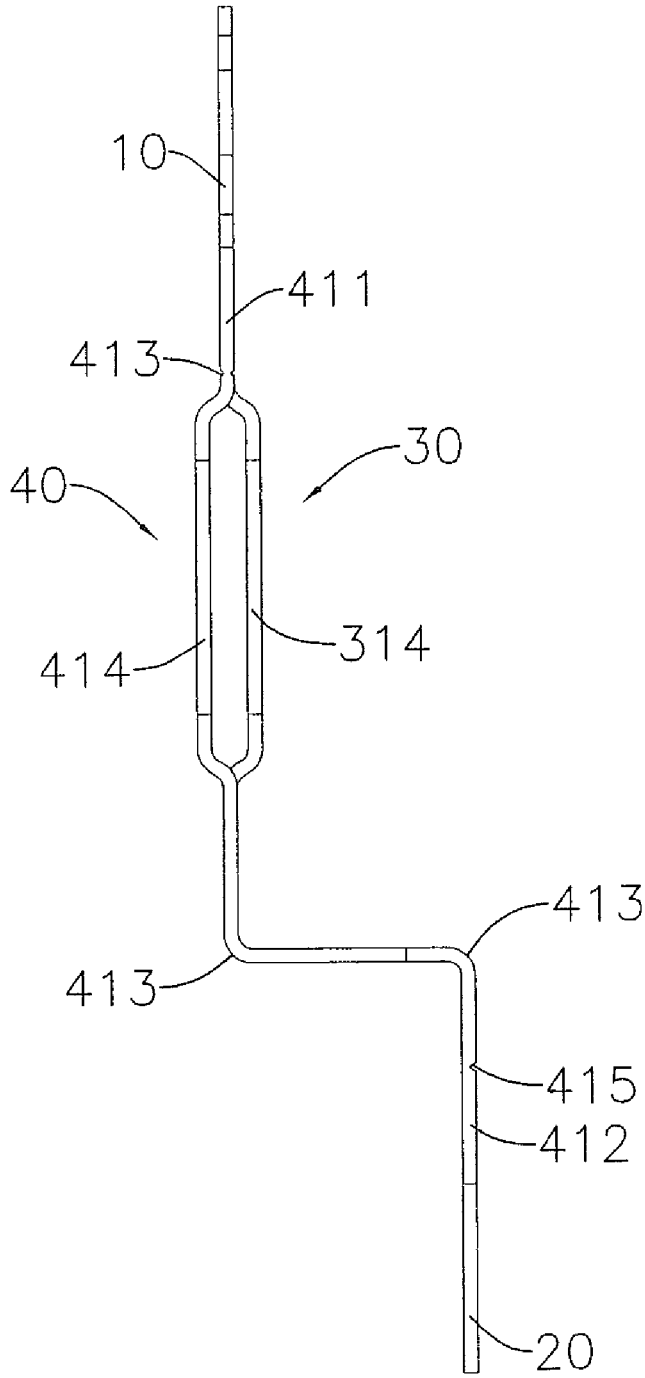
FIG. 4 is a side view of the pin-carrier in FIG. 1.
Figure 6:
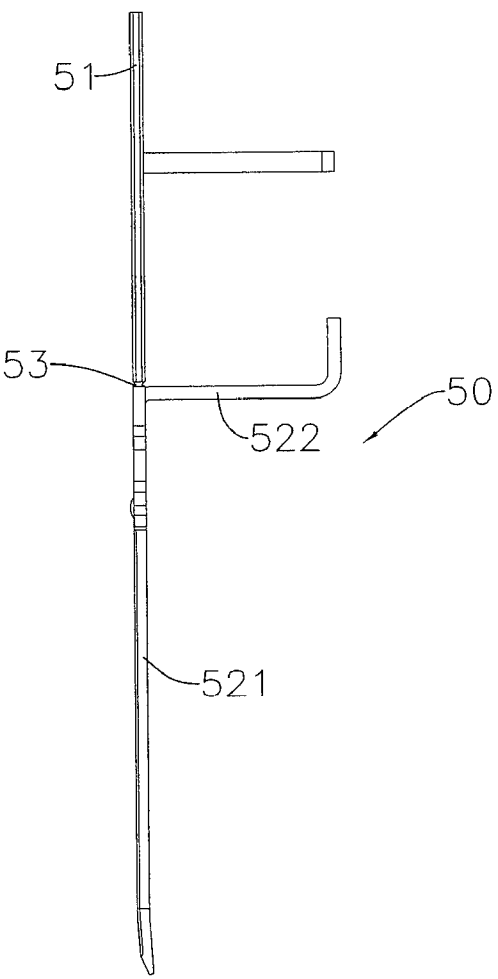
FIG. 6 PRIOR ART
FIG. 6 is a side view of the conventional first pin-carrier in FIG. 5.
Figure 5:
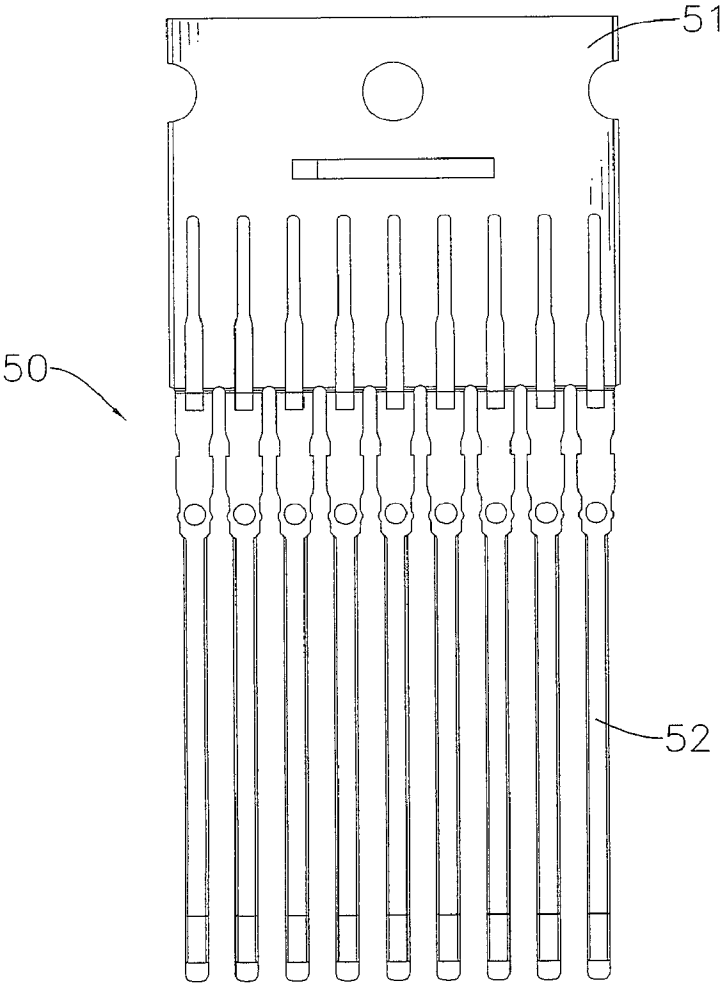
FIG. 5 PRIOR ART
FIG. 5 is a front view of a conventional first pin-carrier in accordance with the prior art.
Figure 8:
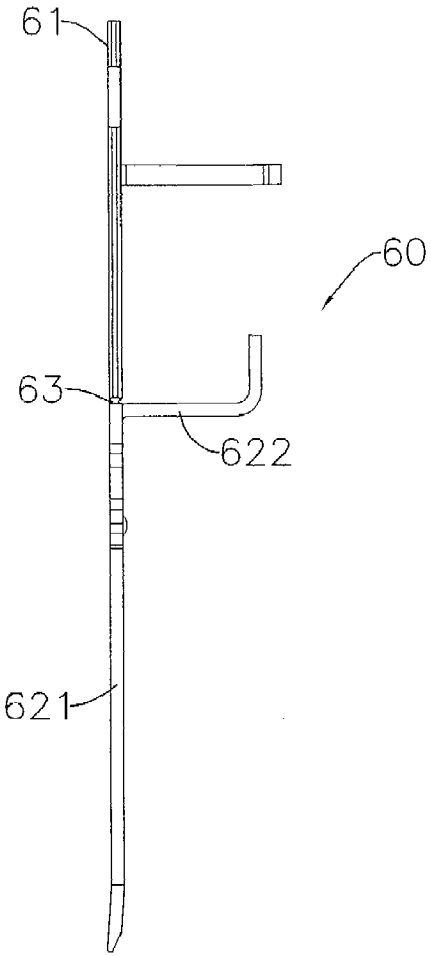
FIG. 8 PRIOR ART
FIG. 8 is a side view of the conventional first pin-carrier in FIG. 7.
Figure 7:
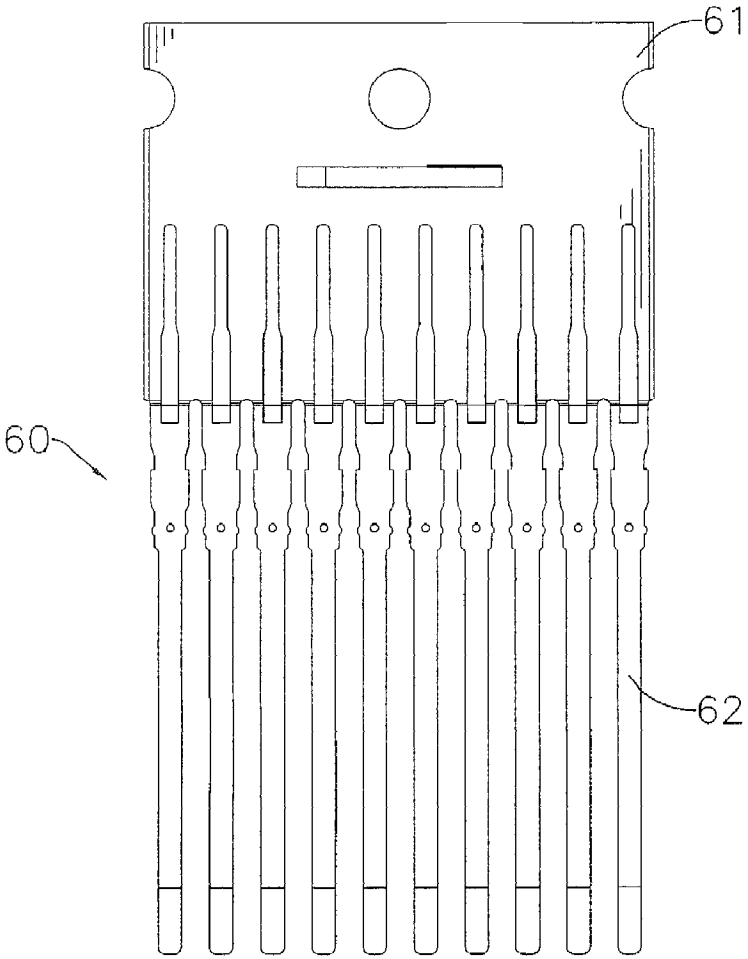
FIG. 7 PRIOR ART
FIG. 7 is a front view of a conventional second pin-carrier in accordance with the prior art.

With further reference to FIGS. 3 and 4, the first pin set (30) has multiple first pins (31), and may be implemented with nine first pins (31). The first pins (31) are separately connected between the main panel (10) and the secondary panel (20). Each first pin (31) may have a first terminal (311), a second terminal (312), a connecting segment (314), a first cutting notch (313) and a second cutting notch (315).

The first terminal (311) of each first pin (31) is connected to the main panel (10).

The second terminal (312) of the first pin (31) is connected to the secondary panel (20) and has an extension section. The extension section of the second terminal (312) is perpendicular to the plane.

The connecting segment (314) is formed adjacent to the first terminal (311) of the first pin (31) and is formed below the plane.

The first cutting notch (313) of the first pin (31) is formed in the first terminal (311) of the first pin (31) adjacent to the main panel (10) and aligns with the cutting notches (313) of the other first pins (31).

The second cutting notch (315) of the first pin (31) is formed in the second terminal (312) of the first pin (31) adjacent to the secondary panel (20) and aligns with the second cutting notches (315) of the other first pins (31).

Figure 2:
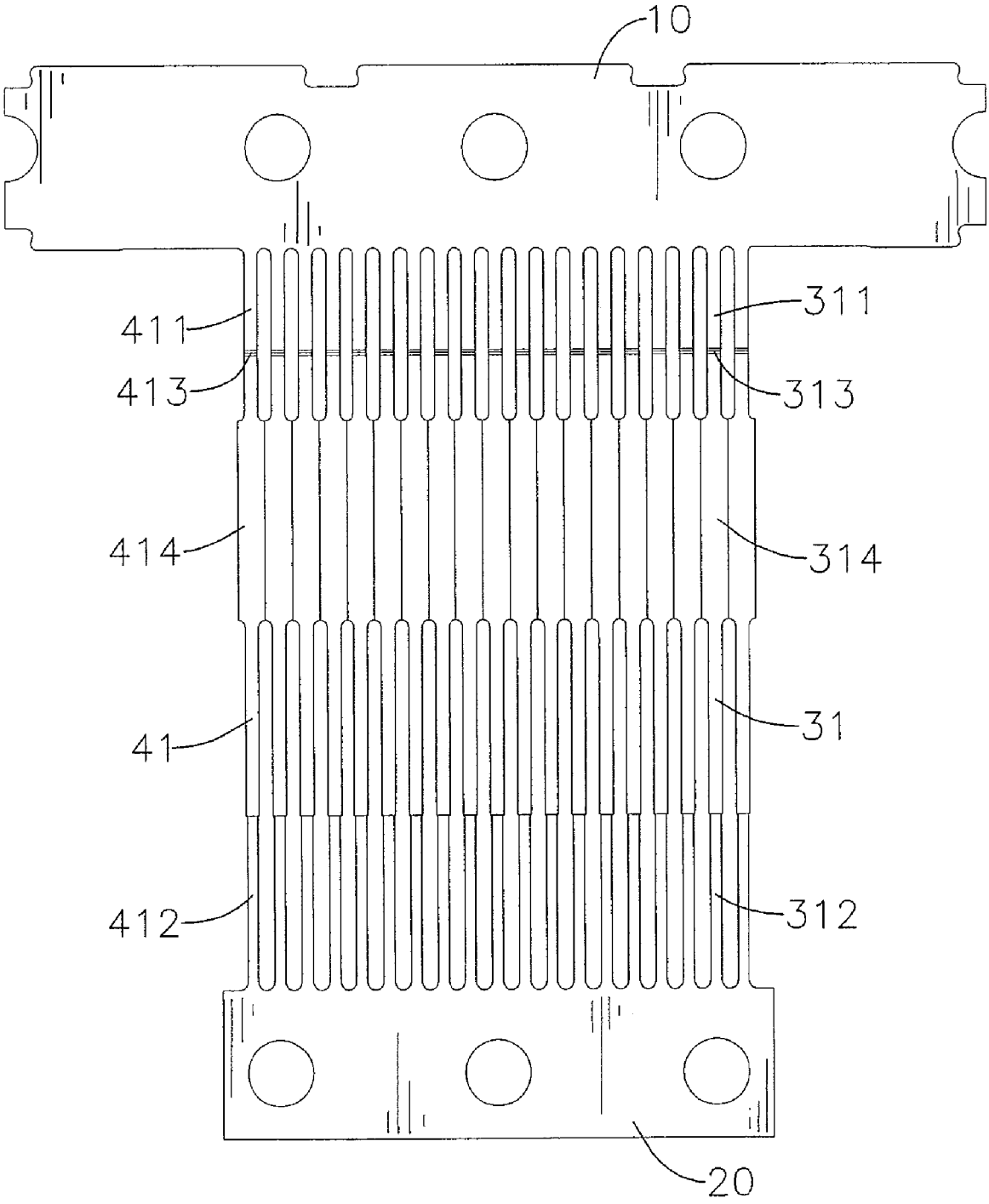
FIG. 2 is a front view of the pin-carrier in FIG. 1.

With further reference to FIG. 2, the second pin set (40) has multiple second pins (41), the second pins (41) may be formed alternately with the first pins (31) and may be implemented with ten second pins (41). The second pins (41) are separately connected between the main panel (10) and the secondary panel (20) and each second pin (41) has a first terminal (411), a second terminal (412), a connecting segment (414), a first cutting notch (413) and a second cutting notch (415).

The first terminal (411) of the second pin (41) is connected to the main panel (10).

The second terminal (412) of the second pin (41) is connected to the secondary panel (20) and has an extension section. The extension section of the second terminal (412) is perpendicular to the plane and aligns with the extension section of the second terminal (312) of the first pin (31).

The connecting segment (414) of the second pin (41) is formed adjacent to the first terminal (411) of the second pin (41) and is formed above the plane.

The first cutting notch (413) of the second pin (41) is formed in the first terminal (411) of the second pin (41) adjacent to the first panel (10) and aligns with the first cutting notches (413, 313) of the other second pins (41) and the first pins (31).

The second cutting notch (415) of the second pin (41) is formed in the second terminal (412) of the second pin (41) adjacent to the secondary panel (20) and aligns with the second cutting notches (415, 315) of the other second pins (41) and the first pins (31).

Therefore, when the second terminals (312, 412) of the pins (31, 41) are aligned, despite the extension sections being the same, the pins (31, 41) form two parallel layers.

The pin-carrier for a connector as described has the following advantages. The pin-carrier is manufactured in fewer steps, requiring fewer tools and materials and with higher yield. Therefore, manufacturing cost and convenience is increased.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pin-carrier comprising
a main panel defining a plane;
a secondary panel being parallel and integral with the main panel;
a first pin set having multiple first pins being separately and integrally connected between the main panel and the secondary panel and each first pin having a connecting segment being formed below the plane; and
a second pin set having multiple second pins being separately and integrally connected between the main panel and the secondary panel, and each second pin having a connecting segment being formed above the plane.

2. The pin-carrier as claimed in claim 1, wherein
each first pin of the first pin set further has
a first terminal being connected to the main panel; and
a second terminal being connected to the secondary panel and having an extension section perpendicular to the plane;
the connecting segment of the first pin is formed adjacent to the first terminal of the first pin;
each second pin of the second pin set further has
a first terminal being connected to the main panel;
a second terminal being connected to the secondary and having an extension section parallel to the plane; and
the connecting segment of the second pin is formed adjacent to the first terminal of the second pin.

3. The pin-carrier as claimed in claim 1, wherein the secondary panel is smaller than the main panel.

4. The pin-carrier as claimed in claim 2, wherein the secondary panel is smaller than the main panel.

5. The pin-carrier as claimed in claim 1, wherein
the first pin set has nine first pins; and
the second pin set has ten second pins.

6. The pin-carrier as claimed in claim 2, wherein
the first pin set has nine first pins; and
the second pin set has ten second pins.

7. The pin-carrier as claimed in claim 3, wherein
the first pin set has nine first pins; and
the second pin set has ten second pins.

8. The pin-carrier as claimed in claim 4, wherein
the first pin set has nine first pins; and
the second pin set has ten second pins.

9. The pin-carrier as claimed in claim 5 is a High-Definition Multimedia interface (HDMI) pin-carrier for an HDMI connector.

10. The pin-carrier as claimed in claim 6 is a HDMI pin-carrier for a HDMI connector.

11. The pin-carrier as claimed in claim 7 is an HDMI pin-carrier for an HDMI connector.

12. The pin-carrier as claimed in claim 8 is an HDMI pin-carrier for an HDMI connector.

13. The pin-carrier as claimed in claim 1, wherein
each first pin further has
a first cutting notch being formed in the first terminal of the first pin adjacent to the main panel and aligning with the cutting notches of the other first pins; and
a second cutting notch being formed in the second terminal of the first pin adjacent to the secondary panel and aligning with the second cutting notches of the other first pins; and
each second pin further has
a first cutting notch being formed in the first terminal of the second pin adjacent to the first panel and aligning with the first cutting notches of the other second pins and the first pins; and
a second cutting notch being formed in the second terminal of the second pin adjacent to the secondary panel and aligning with the second cutting notches of the other second pins and the first pins.

14. The pin-carrier as claimed in claim 2, wherein
each first pin further has
a first cutting notch being formed in the first terminal of the first pin adjacent to the main panel and aligning with the cutting notches of the other first pins; and
a second cutting notch being formed in the second terminal of the first pin adjacent to the secondary panel and aligning with the second cutting notches of the other first pins; and
each second pin further has a first cutting notch being formed in the first terminal of the second pin adjacent to the first panel and aligning with the first cutting notches of the other second pins and the first pins; and a second cutting notch being formed in the second terminal of the second pin adjacent to the secondary panel and aligning with the second cutting notches of the other second pins and the first pins.

15. The pin-carrier as claimed in claim 3, wherein each first pin further has a first cutting notch being formed in the first terminal of the first pin adjacent to the main panel and aligning with the cutting notches of the other first pins; and a second cutting notch being formed in the second terminal of the first pin adjacent to the secondary panel and aligning with the second cutting notches of the other first pins; and each second pin further has a first cutting notch being formed in the first terminal of the second pin adjacent to the first panel and aligning with the first cutting notches of the other second pins and the first pins; and a second cutting notch being formed in the second terminal of the second pin adjacent to the secondary panel and aligning with the second cutting notches of the other second pins and the first pins.

16. The pin-carrier as claimed in claim 4, wherein each first pin further has a first cutting notch being formed in the first terminal of the first pin adjacent to the main panel and aligning with the cutting notches of the other first pins; and a second cutting notch being formed in the second terminal of the first pin adjacent to the secondary panel and aligning with the second cutting notches of the other first pins; and each second pin further has a first cutting notch being formed in the first terminal of the second pin adjacent to the first panel and aligning with the first cutting notches of the other second pins and the first pins; and a second cutting notch being formed in the second terminal of the second pin adjacent to the secondary panel and aligning with the second cutting notches of the other second pins and the first pins.

* * * * *